US005471973A

United States Patent [19]

Wilhoite

[11] Patent Number: 5,471,973

[45] Date of Patent: Dec. 5, 1995

[54] DIRECT VENT FIREPLACE

[75] Inventor: Murray O. Wilhoite, Franklin, Tenn.

[73] Assignee: Temco Fireplace Products, Inc., Nashville, Tenn.

[21] Appl. No.: 369,171

[22] Filed: Jan. 5, 1995

[51] Int. Cl.[6] ..... F23M 7/00

[52] U.S. Cl. ..... 126/200; 126/512

[58] Field of Search ..... 126/200

[56] References Cited

U.S. PATENT DOCUMENTS 4,638,788 1/1987 Lancelot ..... 126/200

*Primary Examiner*—Carroll B. Dority
*Attorney, Agent, or Firm*—Alan Ruderman

[57] ABSTRACT

A gas fueled direct vent fireplace having a firebox within which flue gases are generated includes a glass face access door for closing the front of the fireplace and facing the interior of a room within which the fireplace is located. Flue gases exit remote from the front. A first seal is positioned about the periphery of the open front of the fireplace at locations accessible to flue gases for abutting the glass. A second seal is positioned about the periphery of the glass outwardly of the first seal so that only flue gases which leak past the first seal may contact the second seal. The first seal is formed from fiberglass which has high temperature characteristics. The second seal is formed from a silicone elastomeric material. With this arrangement leakage of hot gases into the adjoining room is substantially eliminated and the life of the elastomeric seal may be extended indefinitely relative to that of the prior art.

17 Claims, 2 Drawing Sheets

DIRECT VENT FIREPLACE

BACKGROUND OF THE INVENTION

This invention relates to a gas burning direct vent fireplace having a glass access door fitted at the room facing front of the firebox, and more particularly to an extended life sealing system for sealing the access door against leakage of flue gases into the room.

In direct vent fireplaces of the type illustrated in Shinek et al U.S. Pat. No. 4,793,322, the firebox, i.e., the combustion chamber or housing within which the hot flue gases are generated, vents directly through an outside wall to the exterior of the building in which the room is located and receives the fresh air which supports combustion from substantially that same exterior location. Room air is drawn through the front of the fireplace below the firebox, rises above the firebox over the top and exhausts at the front. As the room air flows about and over the firebox, it is heated so that it enters the room as heated air. An array of artificial logs or the like may be disposed within the firebox and gas, such as natural gas or propane, may be ignited to create a flame which in conjunction with the logs simulates the aesthetics of actual burning logs. The front of the fireplace, between the locations where the air enters from the room and where the heated air returns to the room, general includes an access door which includes a tempered or ceramic glass in the central area for viewing the flames.

In the prior art an elastomeric silicone polymer gasket has been glued about the glass front to seal the room from the flue gases within the firebox. The silicone gasket provides a good seal. However, it does not have very high temperature characteristics. Additionally, the glue must also withstand the high temperatures of the flue gases so that expensive high temperature glues are required for securing the gasket to the glass. For example, at temperatures in the range of 575° F. to 600° F., a temperature to which the seal is exposed in this environment, silicone gaskets become hard and brittle, and thereby age or deteriorate rapidly. For example, failure of the gasket may occur over a two year period of time. For this reason the American Gas Association (A.G.A.) and the Canadian Gas Association (C.G.A.) have modified their standards by permitting additional leakage past the glass into the room so as to permit the use of fiberglass seals instead of the silicone. Fiberglass has substantially greater high temperature characteristics relative to silicone, but it is porous and does not provide a very effective seal. In fact, the A.G.A. and C.G.A. standards recognize this fact since the leakage now permitted by these standards is about twice as much as heretofore permitted visa vis silicone. In a well sealed room, the content of the air in the room may receive carbon monoxide by this additional leakage of flue gases. This may, over an extended period of time, result in deleterious effects on persons or articles within the room.

SUMMARY OF THE INVENTION

Consequently, it is a primary object of the present invention to provide an extended life sealing arrangement for sealing the access door of a fireplace against leakage of flue gases into an adjacent room.

It is another object of the present invention to provide a high temperature seal about the periphery of the open front of the firebox of a fireplace having an access door with a glass front closing the opening, the seal abutting the glass, and a low leakage seal about the periphery of the glass, the high temperature seal limiting the hot gases which contact the low leakage seal.

It is a further object of the present invention to provide a seal of fiberglass about the periphery of the frontal opening of the firebox of a fireplace intermediate the firebox and a glass panel access door, the seal abutting the glass spaced from the periphery of the glass panel, and an elastomeric silicone seal about the periphery of the glass panel, the silicone seal having a cross sectional configuration for attachment to the periphery of the glass without glue and acting to seal against flue gases leaking past the fiberglass seal.

Accordingly, the present invention provides a fireplace having a firebox within which flue gases are generated, the firebox having a glass panel front access door closing the frontal opening and facing the interior of a room within which the fireplace is located, the flue gases exiting remote from the front. The fireplace has a first seal about the periphery of the front of the firebox at locations directly accessible to flue gases and the access door having a second seal located outwardly of the first seal, i.e., about the periphery of the glass panel and thus downstream of the first seal relative to the flow of flue gases, so that only those gases which leak pass the first seal may contact the second seal. The first seal comprises a material which has high temperature characteristics, i.e., it can withstand the temperatures of the hot flue gases without substantial deterioration over time, while the second seal comprises a material which provides substantial leakage preventing ability. Preferably, the first seal comprises fiberglass material and the second seal comprises a dense elastomeric material such as a silicone polymer. The second seal in accordance with another aspect of the present invention is a cross section such that it may be fitted and secured about the glass periphery of the access door without the use of adhesives so that expensive high temperature adhesives are not necessary. With this construction, an effective seal is provided so that leakage of the flue gases past the access door into the interior of the room is minimized over a long duration.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
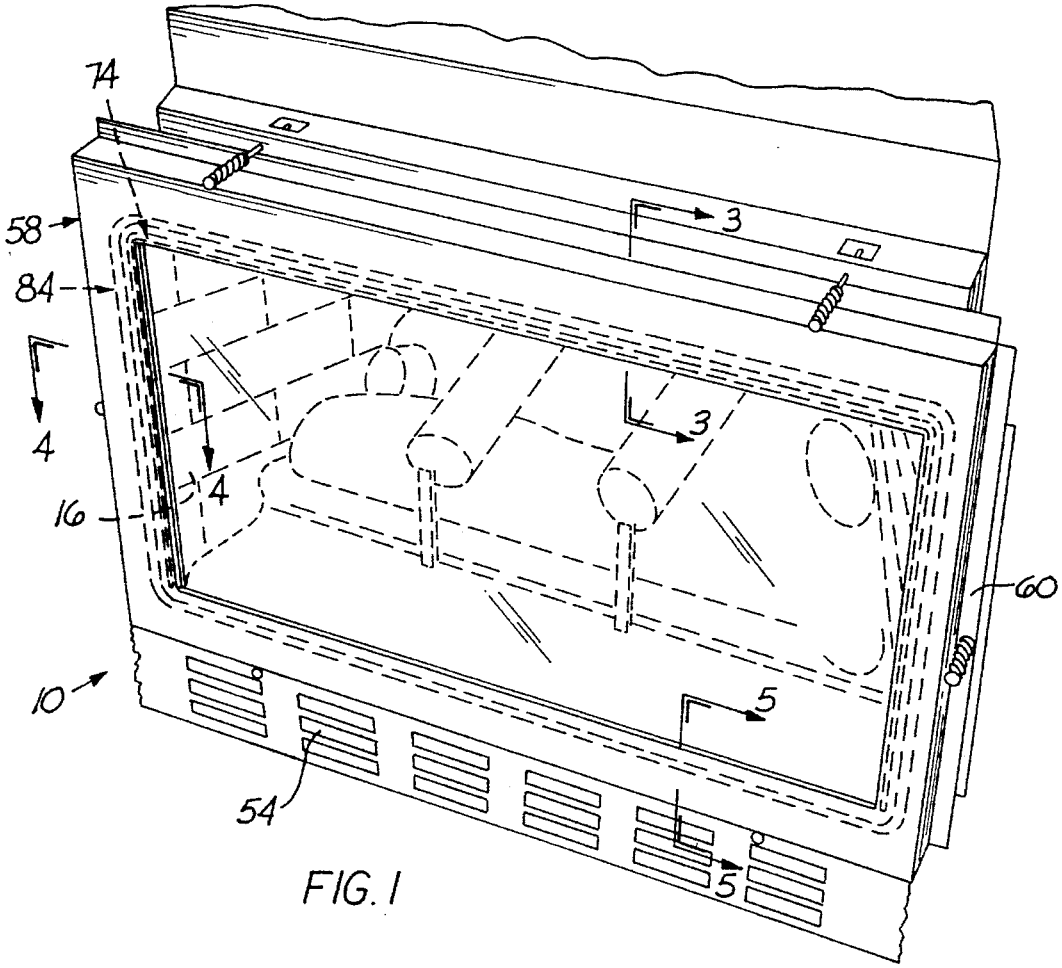
FIG. 1 is a front perspective view illustrating a fireplace having access door seals constructed in accordance with the principles of the present invention, portions of the fireplace being broken away for purposes of presentation.
Figure 2:
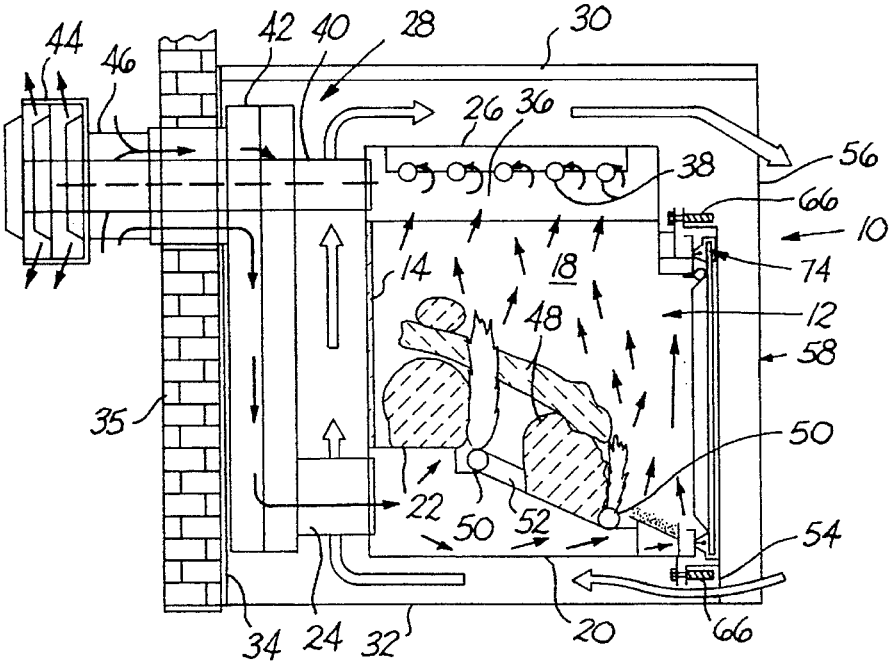
FIG. 2 is a vertical cross section view taken through the fireplace illustrated in FIG. 1 partly in diagrammatic form.
Figure 3:
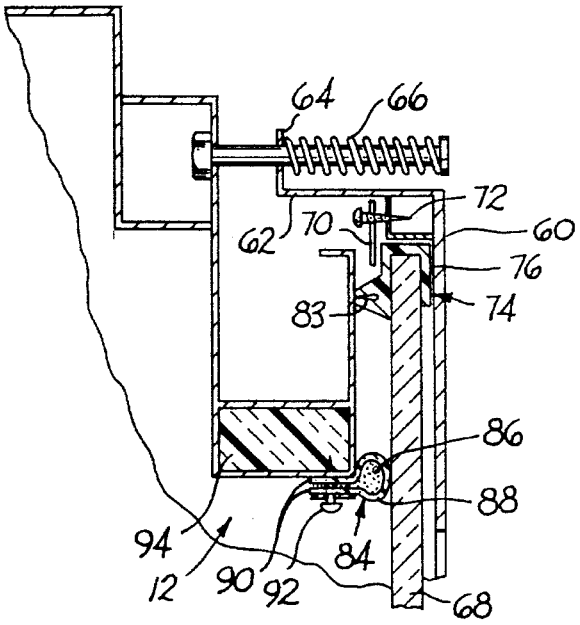
FIG. 3 is a fragmentary cross sectional view taken substantially along line 3—3 of FIG. 1.
Figure 4:
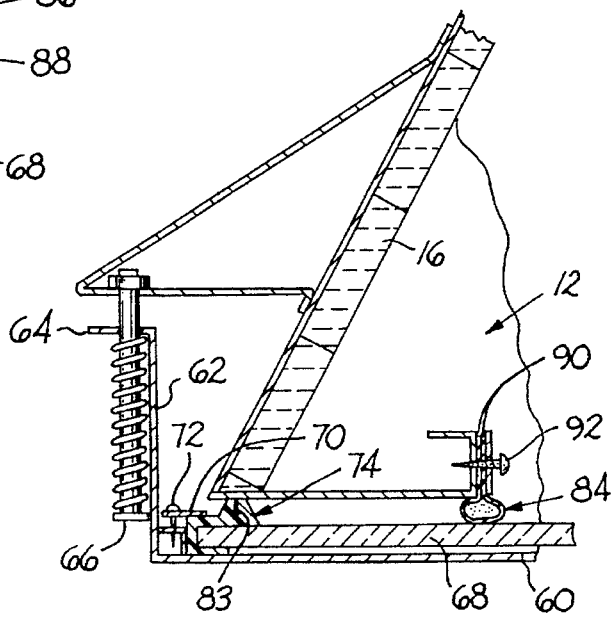
FIG. 4 is a fragmentary cross sectional view taken substantially along line 4—4 of FIG. 1.
Figure 5:
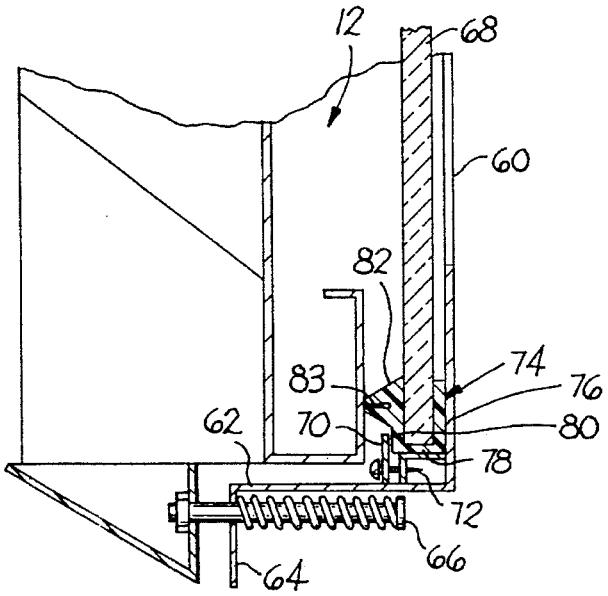
FIG. 5 is a fragmentary cross sectional view taken substantially along line 5—5 of FIG. 1.

Referring to the drawings, the invention is disclosed as applied to a direct vent fireplace 10 having a firebox 12 in the form of a metal box open at the front and having a rear wall 14 and side walls 16, 18 welded thereto, the interior walls preferably including refractory or firebrick surfaces.

Disposed on a bottom plate 20 welded to the rear and side walls and which may, if desired, also include refractory bricks, is a log support structure or grate 22 which also provides a baffle for combustion air which enters beneath the grate 22 from an air duct 24. The firebox also includes a top wall 26 welded to the rear and side walls. The firebox 12 is disposed within an outer chamber 28 including a top wall 30, a bottom wall 32, a rear wall 34, which may abut an outside wall 35 of the room within which the fireplace is located, and side walls which are not illustrated. At the top of the firebox 12 a substantially U-shape baffle 36 is disposed, the bottom of the baffle faces the interior of the firebox and is closed while the legs are welded to the top wall 26. The hot flue gases within the firebox rise and enter the interior of the baffle 36 through openings 38 in the baffle legs and enter a flue gas exit pipe 40 which communicates with the interior of the baffle 36 and extends through an air box 42 to exit through the rear wall 34 and the outside wall 35 where it communicates with a flue outlet diffuser 44.

Fresh outside air for supporting combustion is drawn into an air inlet air pipe 46, which is coaxially disposed about the flue gas exhaust pipe 40, and enters into the air box 42. The air box 42 is merely a sheet metal box which receives air from the air pipe 46 and supplies the air to the air duct 24, the air pipe 46 and air duct 24 being secured to the air box 42. Thus, fresh outside air for supporting combustion enters the combustion chamber beneath artificial logs 48 supported on the grate 22. Gas fuel, such as natural gas, propane, or the like is supplied to burners 50 through gas ducts 52 and is ignited to create the hot combustion products which exit at the top of the firebox through the baffle 36 and exhaust pipe 40 as heretofore described.

Room air from the room within which the fireplace is disposed enters the outer chamber 28 of the fireplace through a grill 54 at the bottom front end and flows between the bottom wall 32 of the chamber and the bottom plate 20 of the firebox. This room air rises upwardly while being heated between the rear wall 14 of the firebox and the rear wall 34 of the chamber 28, and between the side walls 16, 18 of the firebox and the side walls of the chamber 28. As the room air passes over the firebox and the exhaust pipe 40, it is heated so that as it reaches the space between the top wall 26, 30 of the firebox and chamber respectively, it has been heated and exhausts through a vent 56 at the top front end of the chamber 28 into the room.

Disposed about the periphery of the open front of the firebox at the front of the fireplace for closing the open front is an access door 58. The access door 58 includes a metal frame 60 having rearwardly extending stepped portions 62 with outwardly projecting lips 64 connected to adjacent exterior wall portions of the firebox 12 by spring biased bolt member 66. The frame 60, spaced from its outer periphery, has an open central portion over which a tempered or ceramic glass panel 68 is secured by conventional means such as small metallic tabs 70 connected to the frame 60 by screws 72, the tabs acting to trap peripheral portions of the glass against a portion of an elastomeric gasket or seal 74 disposed about the periphery of the glass and thus outside of the periphery of the firebox opening.

The gasket 74 preferably is a dense silicone polymer having a 35 durometer elasticity and a shore A hardness rating. It includes a first leg 76 which overlays the front surface of the glass and abuts the adjacent rear surface of the frame 60; a second leg 78 which abuts the peripheral edge of the glass; and a third leg 80 which overlays the rear or interior surface of the glass, the leg 80 having a protuberance 82 extending from the surface remote from the glass for abutting front facing surfaces of the firebox spaced from the periphery of the open front thereof to provide a seal. The gasket 74 has a substantially U-shaped configuration for fitting securely about the periphery of the glass without the need for an adhesive and while the protuberance 82 provides a substantially leak-proof seal between the firebox and the glass so that leakage past the seal into the adjacent room is substantially eliminated. Additional flexibility is provided to the protuberance by providing a hollow opening 83 extending lengthwise therethrough, the opening permitting greater compression to the protuberance against the abutting surfaces of the firebox.

Disposed about the periphery of the frontal opening of the firebox at least at the sides and the top thereof, is another seal or gasket 84 having the form of a rope 86 about which an encasing web 88 is wrapped, the web including a pair of legs 90 extending away from the rope 86. The legs 90 provide a means for attachment of the gasket 84 by threaded fasteners 92 to portions of the firebox; adjacent the front facing surface, which may include a block of fiberglass insulation 94 at the upper portion at the front of the firebox. There is no need to provide the gasket or seal about the bottom of the opening of the firebox since the flue gases are generated above this level and rise upwardly. The gasket 84 is constructed from fiberglass which provides a long life seal in the range of temperatures of the firebox. Fiberglass, as known in the art, is a material comprising fine filaments of glass combined into yarns and woven into fabric, twisted into rope or processed in mass for use as an insulator. This seal is substantially identical to that used in the prior art and thus is somewhat porous. However, since it is disposed about the firebox opening and is thus inwardly of the .gasket 74, any leakage of gas which occurs past the seal 84 is prevented from leaking past the gasket 74. The fiberglass gasket 84 is thus a heat shield and flue products shield which prevents flue products from directly contacting the silicone gasket 74 so that the latter is under a relatively low temperature compared to that of the flue gases. Additionally, upon start-up of the fire in the firebox, any flue products which condense, and which is slightly acidic, will not condense on the gasket. In the prior art, when silicone gaskets have been used, the acidic condensed flue products act to further reduce the life of the gasket. Thus, not only is the silicone gasket protected from high temperatures by the fiberglass gasket, but the start-up acidity problem is eliminated.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A fireplace including a firebox within which combustion products including flue gases are generated, said firebox having a frontal opening facing an adjoining room, means for venting said flue gases out of said firebox remote from said frontal opening, an access door for closing said frontal opening to keep flue gases from flowing into said room, said door having a frame including front and rear surfaces and a substantially central opening, said frame having an outer periphery larger than said frontal opening, a glass panel having a periphery larger than said central opening connected to said frame adjacent said rear surface for closing said central opening and for permitting viewing of the interior of said firebox from said room, means for fastening said frame to said firebox about said frontal opening for closing said frontal opening, a first seal connected to said firebox adjacent to at least portions of the periphery of said frontal opening exposed to flue gases and abutting said glass at locations spaced from the periphery of said glass, and a second seal disposed about the periphery of said glass for abutting said firebox spaced about said frontal opening, whereby said first seal limits the flow of flue gases toward the periphery of said glass panel and said second seal is contacted only by flue gases which leak past said first seal.

2. A fireplace as recited in claim 1, wherein said first seal comprises a fiberglass gasket.

3. A fireplace as recited in claim 1, wherein said second seal comprises elastomeric material.

4. A fireplace as recited in claim 3, wherein said second seal is a silicone polymer.

5. A fireplace as recited in claim 1, wherein said second seal has a substantially U-shaped cross sectional configuration including a pair of spaced apart legs connected together by a spanning portion, a protuberance extending from one of said legs in a direction remote from the other of said legs, said second seal being disposed about the periphery of said glass panel with said protuberance ,abutting said firebox and said other of said legs abutting said rear surface of said frame.

6. A fireplace as recited in claim 5, wherein said first seal comprises a fiberglass gasket.

7. A fireplace as recited in claim 5, wherein said second seal comprises elastomeric material.

8. A fireplace as recited in claim 7, wherein said second seal is a silicone polymer.

9. A fireplace as recited in claim 8, wherein said first seal comprises a fiberglass gasket.

10. A fireplace as recited in claim 1, wherein said first seal comprises a material durable over long periods of time when exposed to temperatures in the range of 575° F. to 600° F.

11. A fireplace as recited in claim 10, wherein said first seal comprises fiberglass.

12. A fireplace as recited in claim 5, wherein said protuberance includes a hollow cavity extending lengthwise therethrough.

13. A fireplace as recited in claim 12, wherein said second seal comprises elastomeric material.

14. A fireplace as recited in claim 13, wherein said second seal is a silicone polymer.

15. A fireplace as recited in claim 13, wherein said first seal comprises a material durable over long periods of time when exposed to temperatures in the range of 575° F. to 600° F.

16. A fireplace as recited in claim 15, wherein said first seal comprises fiberglass.

17. A fireplace as recited in claim 16, wherein said second seal is a silicone polymer.

* * * * *